US005559075A

United States Patent [19]

Leenders et al.

[11] Patent Number: 5,559,075

[45] Date of Patent: Sep. 24, 1996

[54] RECORDING MATERIAL FOR DIRECT THERMAL IMAGING

[75] Inventors: Luc Leenders, Herentals; Luc Bastiaens, Brasschaat, both of Belgium

[73] Assignee: Agfa-Gevaert, Mortsel, Belgium

[21] Appl. No.: 419,821

[22] Filed: Apr. 11, 1995

[30] Foreign Application Priority Data

May 2, 1994 [EP] European Pat. Off. ..... 94201207

[51] Int. Cl.[6] ..... B41M 5/30; B41M 5/40

[52] U.S. Cl. ..... 503/201; 430/338; 430/567; 430/608; 430/619; 503/202; 503/209; 503/210; 503/216; 503/217; 503/221; 503/226

[58] Field of Search ..... 430/338, 567, 430/608, 619; 503/200–202, 208–211, 217, 218, 226

[56] References Cited

U.S. PATENT DOCUMENTS

| | | | |
|---|---|---|---|
| 4,421,560 | 12/1983 | Kito et al. | 106/21 |
| 4,904,572 | 2/1990 | Dombrowski et al. | 430/332 |
| 5,196,297 | 3/1993 | Dombrowski et al. | 430/338 |
| 5,198,406 | 3/1993 | Mack et al. | 503/207 |
| 5,278,127 | 1/1994 | Dombrowski et al. | 503/207 |

*Primary Examiner*—Bruce H. Hess
*Attorney, Agent, or Firm*—Brumbaugh, Graves, Donohue & Raymond

[57] ABSTRACT

A heat-sensitive recording material suited for use in direct thermal imaging by means of an information-wise energized heating element, which recording material comprises on the same side of a support, called the heat-sensitive side, one or more binder layers containing a substantially light-insensitive metal salt in thermal working relationship with at least one organic reducing agent, characterized in that said recording material also comprises an acid-sensitive leuco dye transformable into dye by means of an acid-reacting compound serving as dye developer that stands in thermal working relationship with said leuco dye.

13 Claims, 2 Drawing Sheets

RECORDING MATERIAL FOR DIRECT THERMAL IMAGING

DESCRIPTION

1. Field of the Invention

The present invention relates to a heat-sensitive recording material suited for use in direct thermal imaging.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.

2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye-binder layer wherefrom dyed portions or solely the dye molecules are transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et al., describing the production of a silver metal image by means of a thermally induced oxidation-reduction reaction of a silver soap with a reducing agent.

Figure 1:
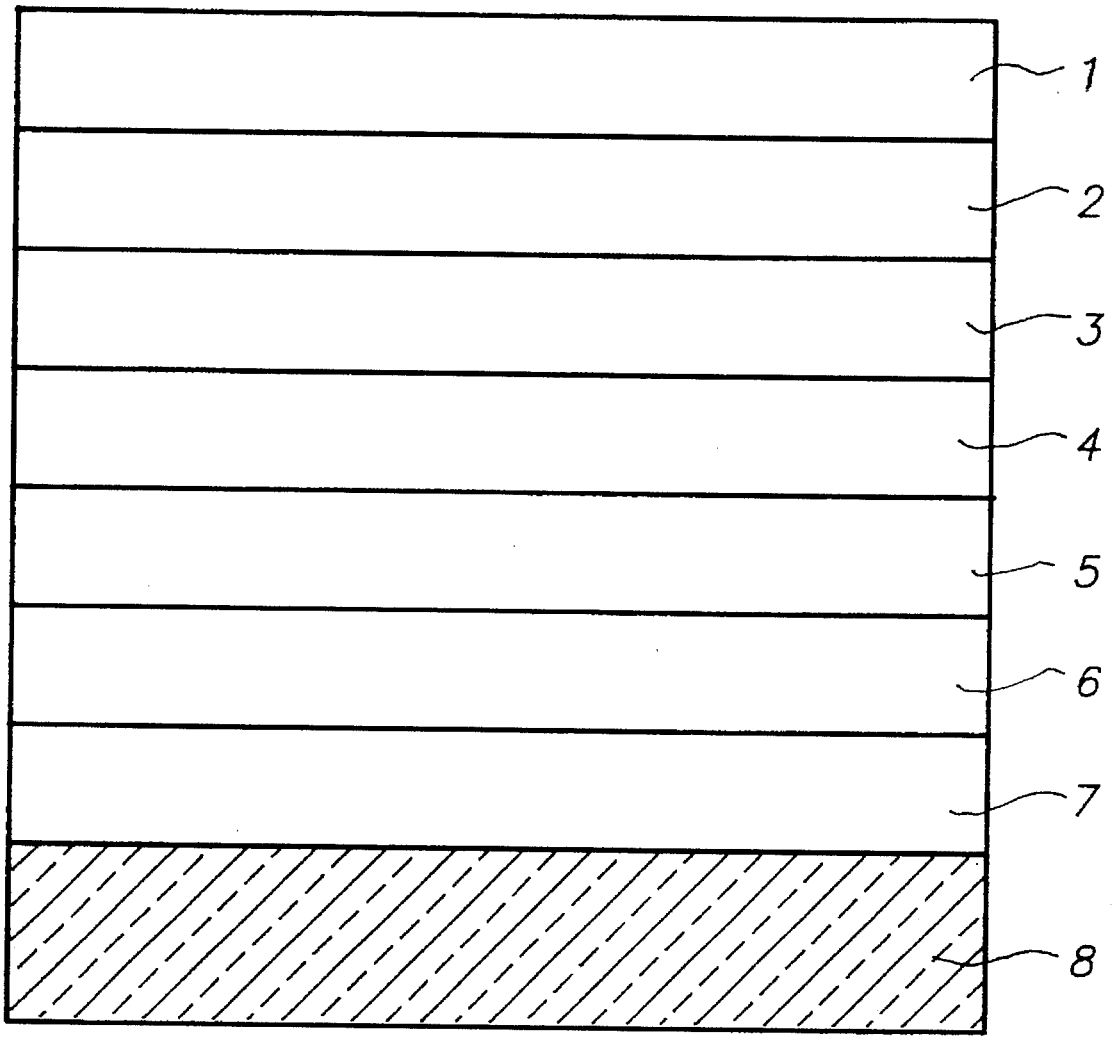
Figure 2:
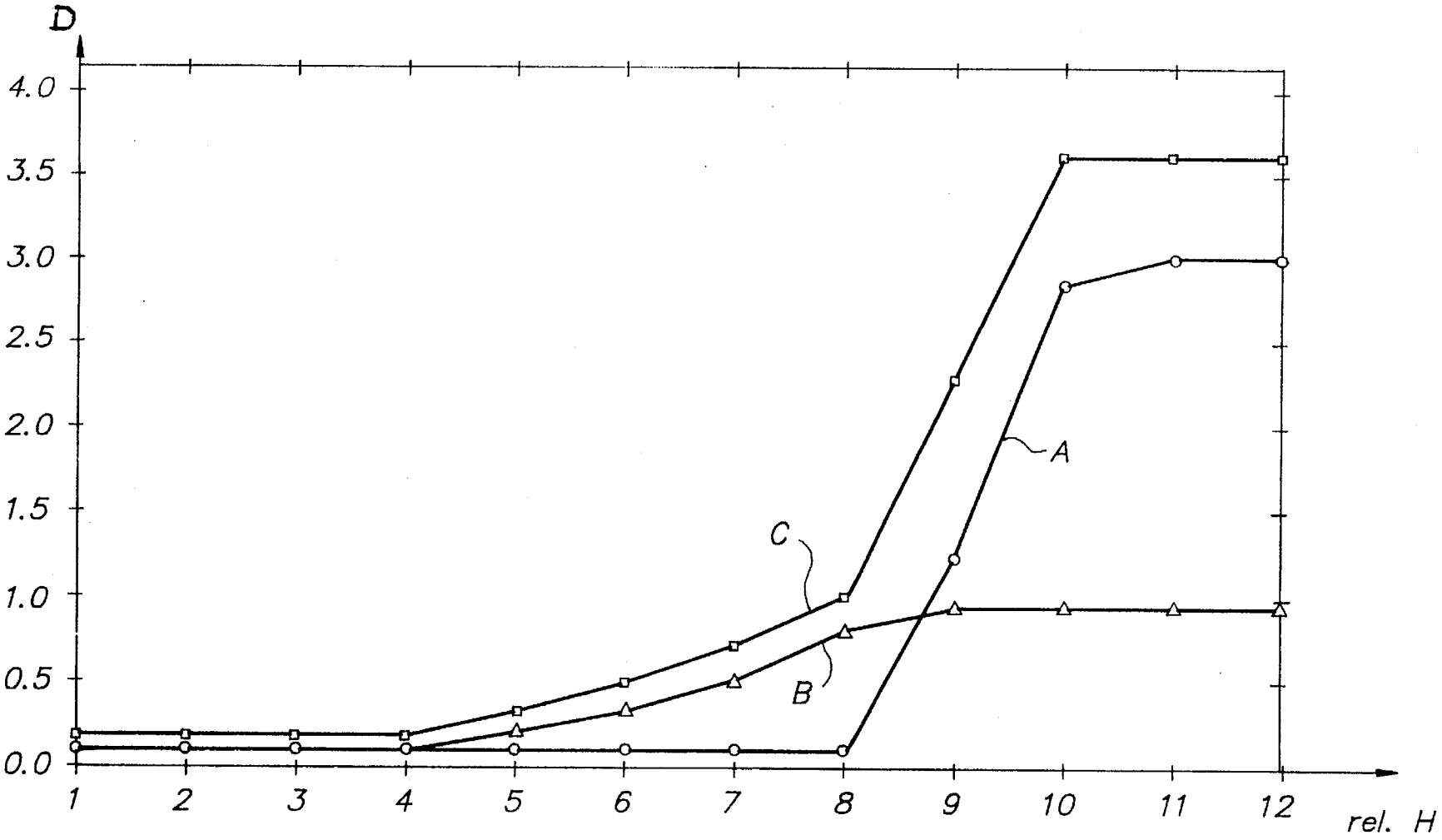

According to U.S. Pat. No. 3,080,254 a typical heat-sensitive copy paper includes in the heat-sensitive layer a thermoplastic binder, e.g. ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–499 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place.

The operating temperature of common thermal printheads is in the range of 300° to 400° C. as can be learned from the above mentioned "Handbook of Imaging Materials", p. 502, and the heating time per picture element (pixel) may be less than 1.0 ms, the pressure contact of the thermal printhead with the recording material being e.g. 200–500 g/cm$^2$ to ensure a good transfer of heat.

The image signals for modulating the heating of the thermal printhead elements are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Heat-sensitive copying papers including a recording layer having a substantially light-insensitive organic silver salt and a hydroxylamine type reductor in a thermoplastic binder such as ethyl cellulose and after-chlorinated polyvinyl chloride are described in U.S. Pat. No. 4,082,901. When used in thermographic recording operating with thermal printheads said copying papers will not be suited for reproducing images with fairly large number of grey levels as is required for continuous tone reproduction.

According the above mentioned Handbook of Imaging Materials (ref. p. 499–501) direct thermal recording operating with a leuco dye system is now in commercial use.

In an embodiment described by T. Usami and A. Shimura in Journal of Imaging Technology, Vol. 16, No. 6, December 1990, p. 234–237 a particular leuco dye system on transparent film base works with encapsulated leuco dye in a recording layer containing a so-called "developer" (e.g. acid-reacting bisphenol compound dissolved in an organic solvent and dispersed in a water-soluble binder. From the optical density versus temperature curve (FIG. 11 on page 236) can be learned that for temperatures of about 130° C. the optical density is not higher than 1.5 and does not increase anymore.

Neither direct thermal mono-sheet recording materials nor two-sheet thermal dye transfer recording materials (dye donor and receptor materials) on the market have the capability of yielding images with maximal optical density above 2.5 and gradation offering continuous tone reproduction.

However, in particular applications such as in the field of medical diagnostics it is a requirement to meet the above imaging capabilities and direct thermal recording materials will only be suited therefor when possessing the mentioned sensitometric results of optical density and gradation.

According to published European patent application No. 0 622 217 A1, which relates to a method for making an image using a direct thermal imaging element, improvements in continuous tone reproduction are obtained by heating the thermal recording element by means of a thermal printhead having a plurality of heating elements, characterized in that the activation of the heating elements is executed line by line with a duty cycle Δ representing the ratio of activation time to total line time in such a way that the following equation is satisfied:

$$P \leqq P_{max} = 3.3\ W/mm^2 + (9.5\ W/mm^2 \times \Delta)$$

wherein $P_{max}$ is the maximal value over all the heating elements of the time averaged power density P (expressed in $W/mm^2$) dissipated by a heating element during a line time.

By controlling the heating of the heating elements of a thermal printhead in the way as described in said EP-A a substantial improvement in continuous tone reproduction with a silver salt/reductor redox system is obtained already, yet from the side of the composition of the thermal recording element further improvements to lower the image gradation are still desirable.

3. Objects and Summary of the Invention

It is an object of the present invention to provide a heat-sensitive recording material suited for use in direct thermal imaging, wherein said material is capable of yielding images having an optical density higher than 2.0 and having a gradation, especially in the lower density portions, suited for continuous tone reproduction as is needed e.g. in portrait reproduction for identification documents and in the medical diagnostic field based on images produced by e.g. radiography, ultrasound or nuclear magnetic resonance (NMR) signals.

It is another object of the present invention to use said recording material in direct thermal recording wherein the imagewise heating proceeds with a thermal printhead containing a plurality of image-wise electrically energized heating elements.

Other objects and advantages of the present invention will appear from the further description.

According to the present invention a heat-sensitive recording material suited for use in direct thermal imaging by means of an information-wise energized heating element is provided, which recording material comprises on the same side of a support, called the heat-sensitive side, one or more binder layers containing a substantially light-insensitive metal salt in thermal working relationship with at least one organic reducing agent, characterized in that said recording material also comprises an acid-sensitive leuco dye transformable into dye by means of an acid-reacting compound serving as dye developer that is in thermal working relationship with said leuco dye.

The terminology "in thermal working relationship" expresses the possibility that the substances forming reaction products increasing the optical density of the recording material may be present in a same or different layers wherefrom by heat they can come into reactive contact with each other, e.g. by thermally induced diffusion.

The layer(s) in which an increase of optical density can take place is (are) called recording or imaging layer(s).

The present invention includes likewise a recording process wherein said recording material is exposed to a heat pattern in direct thermal imaging, by which is meant that during the application of said heat pattern a visible image is formed in said recording material without the aid of (a) substance(s) that from the exterior are thermally pattern-wise transferred thereon and/or therein.

In particular the present invention provides a thermographic recording process with improved continuous tone reproduction wherein said heat-sensitive recording material is image-wise heated by means of a thermal printhead containing a plurality of image-wise electrically energized heating elements.

4. BRIEF DESCRIPTION OF THE DRAWINGS

FIG. 1 represents a schematic cross-sectional drawing of a recording material according to the present invention.

FIG. 2 represents characteristic sensitometric curves of prints obtained with heat-sensitive "non-invention" and "invention" materials. Said characteristic curves were obtained by plotting optical density (D) (logarithmic values) in the ordinate and linearly increasing amounts of exposure heat (relative values) (rel. H) in the abscissa.

5. DETAILED DESCRIPTION OF THE INVENTION

By the use in the present recording material of said metal salt, preferably silver salt, high optical image densities can be obtained thermographically but with insufficient low gradation, whereas the use of said leuco dyes allows the thermal reproduction of image information with much lower gradation but associated with lower maximal optical density. The combination provides as a final result an image with high maximal optical density and gradation low enough for continuous tone reproduction at least in the lower optical densities.

The term "gradation" refers to the slope of a characteristic curve representing the relationship of optical density (D) plotted in the ordinate versus linearly increasing amounts of heat plotted in the abscissa, said different amounts of heat being applied to the thermographic material in neighbouring area analogously to the production of a stepwedge.

The linear increase of heat is obtained e.g. by linearly increasing the heating time at different areas of the recording material while keeping the heat input (J) per time unit (s) constant. Alternatively the heating time can be kept constant and the amount of input-heat is increased linearly.

By definition all gradients or slopes of said characteristic curve create together the gradation of the thermographic image. A gradient corresponds with the slope at a single point on the characteristic curve. The gamma (γ) is the maximum gradient of said characteristic curve, which is normally the gradient between the end of the toe and the beginning of the shoulder of the characteristic curve.

The recording material according to the present invention yields a gradation, particularly in the range of the lower heating energy values, which is much lower than can be obtained without using the leuco dye-developer system in combination with an organic silver salt redox system, which in its turn gives rise to a desired maximal optical density higher than 2.

According to a particular embodiment the acid-sensitive leuco dye and acid-reacting dye developer therefor are separated by a barrier layer that on heating the recording material is permeable for at least one of said dye forming reagents thereby improving the storage keepability of the recording material at room temperature (20° C.) and normal (30%) relative humidity conditions. Such barrier layer works to some extent as a heat-insulating spacer layer in that the imaging layer more remote from the heating element(s) receive(s) less heat whereby the optical density in correspondence with the total heating range will be better differentiated giving rise to a larger amount of visually recognizable "gray-levels" (lower gradation) in the final print.

Said barrier layer is made preferably of a hydrophobic polymer having a glass transition temperature (Tg) below 20° C. and a melting temperature (Tm) in the range of 100° to 200° C. Such polymers are e.g. polyvinylidene chloride (Tg=−17° C., Tm=198° C.), polyethene (Tg=−120° C., Tm=137° C.), polypropene (Tg=−15° C., Tm=167° C.) and polyisobutene (Tg=−65° C., Tm=128° C.).

The chemical reactants as specified herein for thermally producing an optical density increase are applied in one or more layers that contain as binder all kinds of natural, modified natural or synthetic resins, e.g. cellulose derivatives such as ethylcellulose, cellulose esters, carboxymethylcellulose, starch ethers, galactomannan, polymers derived from α,β-ethylenically unsaturated compounds such as polyvinyl chloride, after-chlorinated polyvinyl chloride, copolymers of vinyl acetate and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters and polyethylene or mixtures thereof.

A particularly suitable binder is polyvinyl butyral containing a minor amount of vinyl alcohol units being marketed under the tradename BUTVAR B79 of Monsanto USA.

The weight ratio of binder to imaging substances in an imaging layer of the direct thermal recording material according to the present invention is preferably in the range of 0.2 to 6, and the thickness of an imaging layer is preferably in the range of 8 μm to 16 μm.

The leuco dyes may be present molecularly distributed in a polymeric binder layer or are applied in a polymeric binder layer while being encapsulated in heat-responsive microcapsules having a thermoplastic polymeric wall (envelope) which is permeable to the dye developer on heating. The polymeric envelope material of the microcapsules is e.g. a co(vinyl chloride-vinyl acetate or cellulose diacetate.

The dye developer is preferably present in a polymeric binder wherein the dye developer can be molecularly divided, that way forming a solid solution of dye developer in the binder. Since common dye developers for acid-sensitive leuco dyes have a polar character preferably polar binding agents are used that are soluble in the same organic water-miscible solvents, e.g. acetone, as wherein the acidic dye developer compound is soluble.

Examples of useful polar binding agents soluble in organic water-miscible solvents are: cellulose nitrate having a substitution degree (D.S.) in the range of 2.2 to 2.32.

A major use for acid-sensitive leuco dyes is in carbonless copy paper wherein microcapsules containing solutions of said leuco dye compounds are coated on the back side of the copy paper and, upon being broken by pressure, release the leuco dye which becomes colored upon contacting an acidic clay on the front side of the underlying sheet of the copy paper. See Zollinger: Color Chemistry, published by VCH Verlagsgesellschaft mbH, Weinheim, Germany, pp. 301–303 (1987).

Particularly suited for use according to the present invention are leuco dyes belonging to the class of the fluorans as described e.g, in published European patent application 0 155796 and in German published patent applications (DE-OS) 35 34 594, 43 29 133, and in U.S. Pats. No. 3,957,288, 4,011,352 and 5,206,118.

Preferred fluoran-type leuco dyes correspond to the following general formula (A):

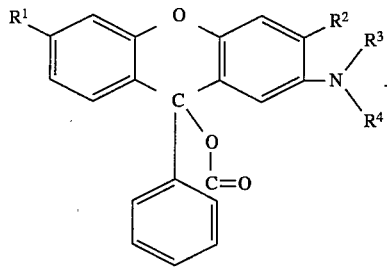

(A)

wherein:

$R^1$ represents a mono- or dialkylamino group including said groups in substituted form, e.g. substituted with a tetrahydrofuryl group, $R^2$ represents hydrogen, F, Cl, C1–C5 alkyl, C1–C5 alkoxy, phenyl or benzyl, $R^3$ represents hydrogen, a C1–C4 alkyl group, an alkaryl group, a cycloalkyl group or an aryl group, e.g. a phenyl group, and $R^4$ represents a C1–C4 alkyl group, an alkaryl group, a cycloalkyl group or an aryl group, e.g. a phenyl group.

Other leuco dyes that by reaction with an acid yield a colored compound are leuco crystal violet, leuco malachite green, crystal violet lactone, benzoyl leuco methylene blue and the acid-sensitive leuco dye compounds belonging to the class of the bisindophtalides and carbazolyl methanes described e.g. in U.S. Pat. No. 5,206,118.

Further are mentioned as acid-sensitive leuco dyes the spiropyran-type dye precursors described in "Unconventional Imaging Processes" by Eric Brinckman et al. The Focal Press London and New York, (1978), p. 90–95 and U.S. Pat. No. 3,810,762.

Electron-accepting or acid-reacting developer compounds suited for transforming said acid-sensitive leuco dyes into colored compounds are e.g. 1,3-bis-p-hydroxycumylbenzene or 1,4-bis-cymylbenzene, p-hydroxybenzoic acid butyl ester (PHBB) and bisphenols such as 4,4'-isopropylidenediphenol (bisphenol A) and compounds analogous thereto described in Journal of Imaging Technology, Vol. 16, Number 6, December 1990, p. 235, and in DE-OS 35 34 594 and 43 29 133.

Other suitable acid-reacting compounds serving as developers for leuco dyes are mono-esters of aromatic ortho-carboxylic acids described e.g. in U.S. Pat. No. 4,011,352, more particularly the ethyl half ester of ortho-phthalic acid.

In a preferred embodiment the reducible metal salt used in the recording material of the present invention is a substantially light-insensitive organic silver salt.

Useful substantially light-insensitive reducible organic metal salts other than silver salts are e.g. iron salts of an organic acid, e.g. the iron salts described in published European patent application 0 520 404, more particularly iron o-benzoylbenzoate.

Substantially light-insensitive organic silver salts particularly suited for use in recording materials according to the present invention are silver salts of aliphatic carboxylic acids known as fatty acids, wherein the aliphatic carbon chain has preferably at least 12 C-atoms, e.g. silver laurate, silver palmirate, silver stearate, silver hydroxystearate, silver oleate and silver behenate, and likewise silver dodecyl sulphonate described in U.S. Pat. No. 4,504,575 and silver di-(2-ethylhexyl)sulfosuccinate described in published European patent application 227 141. Useful modified aliphatic carboxylic acids with thioether group are described e.g. in GB-P 1,111,492 and other organic silver salts are described in GB-P 1,439,478, e.g. silver benzoate and silver phthalazinone, which may be used likewise to produce a thermally developable silver image. Further are mentioned silver imidazolates and the substantially light-insensitive inorganic or organic silver salt complexes described in U.S. Pat. No. 4,260,677.

Suitable organic reducing agents for the reduction of metal salts, preferentially for the reduction of substantially light-insensitive organic silver salts, are organic compounds containing at least one active hydrogen atom linked to O, N or C, such as is the case in aromatic di- and tri-hydroxy compounds, e.g. hydroquinone and substituted hydroquinones, catechol, pyrogallol, gallic acid and gallares: aminophenols, METOL (tradename), p-phenylenediamines, alkoxynaphthols, e.g. 4-methoxy-1-naphthol described in U.S. Pat. No. 3,094,417, pyrazolidin-3-one type reducing agents, e.g. PHENIDONE (tradename), pyrazolin-5-ones, indanedione-1,3 derivatives, hydroxytetrone acids, hydroxytetronimides, hydroxylamine derivatives (ref. e.g. U.S. Pat. No. 4,082,901), hydrazine derivatives, reductones, and ascorbic acid: see also U.S. Pat. No. 3,074,809, 3,080,254, 3,094,417 and 3,887,378.

It has been experimentally stated by us that an improved continuous tone reproduction can be obtained by the use of heat-sensitive recording materials containing a catechol-type reducing agent, by which is meant a reducing agent containing at least one benzene nucleus with two hydroxy groups (—OH) in ortho-position.

Preferred are catechol and polyhydroxy spiro-bis-indane compounds corresponding to the following general formula:

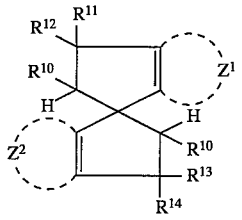

wherein:

$R^{10}$ represents hydrogen or alkyl, e.g. methyl or ethyl, each of $R^{11}$ and $R^{12}$ (same or different) represents H, an alkyl group, e.g. methyl, ethyl or propyl, an alkenyl group or a cycloalkyl group, e.g. cyclohexyl group, or $R^{11}$ and $R^{12}$ together represent the atoms necessary to close a homocyclic non-aromatic ring, e.g. a cylohexyl ring, each of $R^{13}$ and $R^{14}$ (same or different) represents H, an allyl group, e.g. methyl, ethyl or propyl, an alkenyl group or a cycloalkyl group, e.g. cyclohexyl group, or $R^{13}$ and $R^{14}$ together represent the atoms necessary to close a homocyclic non-aromatic ring, e.g. cyclohexyl, each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g. an alkyl or aryl group.

Particularly useful are the polyhydroxy-spiro-bis-indane compounds described in U.S. Pat. No. 3,440,049 as photographic tanning agent, more especially 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II). Indane is also known under the name hydrindene.

Preferably the reducing agent is added to the heat-sensitive imaging layer but as already mentioned all or part of the reducing agent may be added to an adjacent layer wherefrom it can diffuse into the layer containing the substantially light-insensitive silver salt.

The present heat-sensitive recording material may contain one or more primary reducing agents of the type defined above in combination with one or more auxiliary reducing agents having poor reducing power compared with said main reducing agents. The auxiliary reducing agents are incorporated preferably in the heat-sensitive layer containing the organic silver salt. For that purpose sterically hindered phenols and aromatic sulphonamide compounds are useful.

Sterically hindered phenols as described e.g. in U.S. Pat. No. 4,001,026 are examples of such auxiliary reducing agents that can be used in admixture with said organic silver salts without premature reduction reaction and fog-formation at room temperature.

The silver image density depends on the coverage of the above defined reducing agent(s) and organic silver salt(s) and has to be preferably such that on heating above 100° C. an optical density of at least 1.5 can be obtained. Preferably at least 0.10 mole of reducing agent(s) per mole of organic silver salt is used.

For obtaining a neutral black image tone with silver formed in the higher optical density parts and neutral grey in the lower densities the reducible silver salt(s) and reducing agents are advantageously used in conjunction with a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. No. 3,074,809, 3,446,648 and 3,844,797. Particularly useful toning agents are likewise the heterocyclic toner compounds of the benzoxazine dione or naphthoxazine dione type.

A toner compound particularly suited for use in combination with said polyhydroxy spiro-bis-indane reducing agents is 3,4-dihydro-2,4-dioxo-1,3,2H-benzoxazine described in U.S. Pat. No. 3,951,660.

In addition to said ingredients one or more of the imaging layers of the heat-sensitive recording material may contain other additives such as antistatic agents and heat-stabilizers. Preferred antistatic agents are non-ionic and include a fluorocarbon group as in $F_3C(CF_2)_6CONH(CH_2CH_2O)$—H. Suitable heat-stabilizers are described in U.S. Pat. No. 5,206,118. They help to minimize coloring of the acid-sensitive leuco dye during manufacturing of the present thermosensitive recording material. Examples of such heat-stabilizers are Ca/Zn carboxylate compounds commercially available from AKZO Chemie under the tradename INTERSTAB™, a maleic acid free organotin carboxylate commercially available from Ciba-Geigy Corporation under tradename IRGASTAB T, and octyl tin mercaptide sold under the tradename STANCLERE T-200M. Further the recording material may contain ultra-violet absorbing compounds, and/or optical brightening agents.

The polymers or mixtures thereof forming the binder of the recording layer(s) may be used in conjunction with waxes or "heat solvents" also called "thermal solvents" or "thermosolvents" improving the reaction speed of the dye forming reaction and metal, preferably silver, producing redox-reaction at elevated temperature.

By the term "heat solvent" in this invention is meant a non-hydrolyzable organic material which is in solid state below 50° C. but becomes a plasticizer, e.g. from 60° C. on, for the binder with which it is combined in the heated region and/or acts then as solvent for at least one of the color-forming reagents. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydrothiophene-1,1-dioxide, methyl anisate and 1,10-decanediol being described as heat solvents in Research Disclosure, December 1976, (item 15027) pages 26–28. Still other examples of heat solvents have been described in U.S. Pat. No. 3,438,776, and 4,740,446, and in published EP-A 0 119 615 and 0 122 512 and DE-A 3 339 810.

The support for the heat-sensitive recording material according to the present invention is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if need be to improve the adherence to the thereon coated heat-sensitive recording layer.

The coating of the different layers in the present heat-sensitive recording material may proceed by any "thin-layer" coating technique e.g. as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Direct thermal imaging can be used for both the production of transparencies and reflection type prints. Such means that the support may be transparent or opaque, e.g. the support has a white light reflecting aspect. For example, a paper base is used which may contain white light reflecting pigments, optionally also applied in an interlayer between a recording layer and said base. In case a transparent base is used, said base may be colourless or coloured, e.g. has a blue colour.

In the hard copy field recording materials on white opaque base are used, whereas in the medical diagnostic field black-imaged transparencies find wide application in inspection techniques operating with a light box.

The recording materials of the present invention are particularly suited for use in thermographic recording techniques operating with thermal printheads. Suitable thermal printheads are e.g. a Fujitsu Thermal Head (FTP-040 MCS001), a TDK Thermal Head F415 HH7-1089, and a Rohm Thermal Head KE 2008-F3.

In a particular embodiment in order to avoid direct contact of the printheads with a recording layer that has not been provided with an outermost protective layer, the imagewise heating of the recording layer with said printheads proceeds through a contacting but removable resin sheet or web wherefrom during said heating no transfer of imaging material can take place.

In an other embodiment in order to avoid local deformation on heating, to improve resistance against abrasion and in order to avoid the direct contact of the printheads with a recording layer a protective coating is applied thereto. Such coating may have the same composition as an anti-sticking coating or slipping layer which is applied in thermal dye transfer materials at the rear side of the dye donor material.

A slipping layer being said outermost layer may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layer compositions are described in e.g. EP 138483, EP 227090, U.S. Pat. No. 4,567,113, 4,572,860 and 4,717,711 and in published European patent application 311841.

A suitable outermost slipping layer comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Another suitable outermost slipping layer may be obtained by coating a solution of at least one silicon compound and a substance capable of forming during the coating procedure a polymer having an inorganic backbone which is an oxide of a group IVa or IVb element as described in published European patent application 0554576.

Other suitable protective layer compositions that may be applied as slipping (anti-stick) coating are described e.g. in published European patent applications (EP-A) 0 501 072 and 0 492 411. The following example illustrates the present invention. The percentages and ratios are by weight unless otherwise indicated.

EXAMPLE (comparative example)

Thermosensitive recording material A (non-invention material)

A subbed polyethylene terephthalate support having a thickness of 100 μm was doctor blade-coated from a coating composition containing methyl ethyl ketone as a solvent and the following ingredients so as to obtain thereon after drying the following recording layer containing:

| | |
|---|---|
| silver behenate | 4.42 g/m² |
| polyvinyl butyral (BUTVAR B79-tradename) | 4.42 g/m² |
| reducing agent S as defined hereinafter | 0.84 g/m² |
| 3,4-dihydro-2,4-dioxo-1,3,2H-benzoxazine | 0.34 g/m² |

Reducing agent S is a polyhydroxy spiro-bis-indane, viz. 3,3,3',3+-tetramethyl-5,6,5',6'-tetrahydroxy-spiro-bis-indane described already in unpublished European patent application EP-A 599,369 filed 16th November 1992.

Thermosensitive recording material B (non-invention material)

Recording material B was built up in two parts for forming a sandwich, one part B1 containing a leuco dye base and the other part B2 containing as dye developer an acid reacting compound (AC) transferable by heat.

Material B1

A polyethylene terephthalate support having a thickness of 5 μm (DIAFOIL K200—tradename) was coated from a coating composition containing methyl ethyl ketone as a solvent and the following ingredients so as to obtain thereon after drying the following layer containing:

| | |
|---|---|
| co(vinyl chloride-vinyl acetate) (88/12) | 4.00 g/m$^2$ |
| leuco dye base LB | 5.00 g/m$^2$ |

Onto said layer containing the leuco dye base a barrier layer containing 1.0 g/m$^2$ of polyvinylidene chloride was applied from anionic aqueous dispersion.

The leuco dye base LB has the following structural formula:

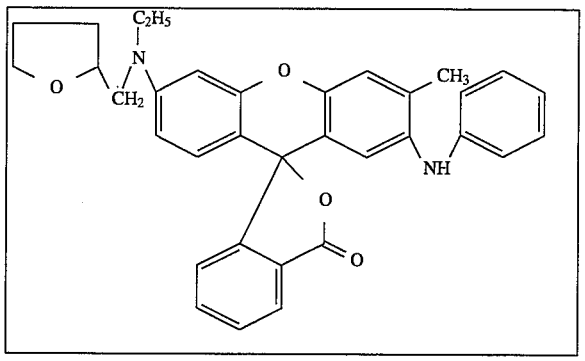

Material B2

A polyethylene terephthalate support having a thickness of 5 μm (DIAFOIL K200—tradename) was coated at one side with a coating composition containing methyl ethyl ketone as a solvent and the following ingredients so as to obtain after drying the following layer containing:

| | |
|---|---|
| cellulose nitrate (DS: 2.3) | 1.25 g/m$^2$ |
| p-hydroxybenzoic acid benzyl ester (AC) | 2.25 g/m$^2$ |

At the opposite side said support was coated with a slipping layer from methyl ethyl ketone to obtain after drying a layer containing:

| | |
|---|---|
| bisphenol polycarbonate | 0.60 g/m$^2$ |
| polysiloxane lubricant | 0.07 g/m$^2$ |

Thermosensitive recording material C (invention material)

Thermosensitive recording material C was formed by joining the materials A, B1 and B2 described above in the sequence shown in FIG. 1, wherein layer 1 is said slipping layer, layer 2 is a 5 μm thick polyethylene terephthalate layer, layer 3 is the acid-containing layer, layer 4 is the barrier layer, layer 5 is the recording layer containing the leuco dye base, layer 6 is a 5 μm thick polyethylene terephthalate layer, layer 7 is the recording layer containing reducing agent and silver behenate and layer 8 is the subbed 100 μm thick polyethylene terephthalate support.

Thermographic printing (1) Recording material A was exposed to a pattern of linearly increasing amounts of heat in a thermal head printer built for thermosensitometric purposes, using a separatable polyethylene terephthalate ribbon of 6 μm thick between the thermal printhead and the outermost side of the heat-sensitive recording layer containing the reductor and silver behenate.

(2) Material B1 having its barrier layer in intimate contact contact with the acid-containing layer of material B2 was exposed through the defined slipping layer to a pattern of linearly increasing amounts of heat with the same thermal head printer as used for exposing recording material A having the thermal printhead in contact with the slipping layer of material B2.

(3) Recording material C being built up as described above by joining recording material A with the sandwiched materials B1 and B2 was exposed through the defined slipping layer to a pattern of linearly increasing amounts of heat produced with the same thermal head printer as used for exposing recording material A having the thermal printhead in contact with the slipping layer of material B2.

From the prints obtained in said materials A. B (combination of B1 and B2) and C characteristic curves A, B and C respectively were plotted in FIG. 2 with optical density (D) (logarithmic values) in the ordinate and linearly increasing amounts of heat (relative values) (rel. H) in the abscissa.

The optical density was measured in transmission with MacBeth TD 904 densitometer behind ortho-filter having its main transmission in the green part (500 nm to 600 nm) of the visible spectrum.

From the obtained curves can be learned that the slope of the linear part (between toe and shoulder) of sensitometric curve A corresponding with the non-invention material A is particularly steep (66°). The obtained density is high (more than 3) but a starting density-increase requires a relatively high amount of heat.

The slope of the linear part (between toe and shoulder) of sensitometric curve B corresponding with the non-invention material B, being a combination of materials B1 and B2 as defined above, is only 20°.

Below density 1 the slope of the sensitometric curve C corresponding with the invention material C is practically the same as the slope of the curve B between its toe and shoulder, and above density 1 the slope of curve C is practically the same as the slope of curve A between its toe and shoulder.

We claim:

1. A heat-sensitive recording material suited for use in direct thermal imaging by means of an information-wise energized heating element, which recording material comprises on the same side of a support, called the heat-sensitive side, one or more binder layers containing a substantially light-insensitive metal salt in thermal working relationship with at least one organic reducing agent, characterized in that said recording material also comprises an acid-sensitive leuco dye transformable into dye by means of an acid-reacting compound serving as dye developer that is in thermal working relationship with said leuco dye, wherein said leuco dye corresponds to the following general formula (A):

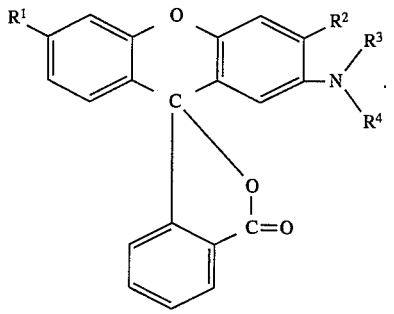

(A)

wherein:

$R^1$ represents a mono- or dialkylamino group in which said aklyl groups are substituted or unsubstituted, $R^2$ represents hydrogen, F, Cl, C1–C5 alkyl, C1–C5 alkoxy, phenyl or benzyl, $R^3$ represents hydrogen, a C1–C4 alkyl group, an alkaryl group, a cycloalkyl group or an aryl group, and $R^4$ represents a C1–C4 alkyl group, an alkaryl group, a cycloalkyl group or an aryl group.

2. Heat-sensitive recording material according to claim 1, wherein said metal salt is a silver salt.

3. Heat-sensitive recording material according to claim 1, wherein said acid-reacting developer compound is a member selected from the group consisting of 1,3-bis-p-hydroxy-cumylbenzene, 1,4-bis-cymylbenzene, p-hydroxybenzoic acid butyl ester, bisphenols and mono-esters of aromatic ortho-carboxylic acids.

4. Heat-sensitive recording material according to claim 1, wherein said reducible metal salt is a substantially light-insensitive organic silver salt of aliphatic carboxylic acids, wherein the aliphatic carbon chain has at least 12 C-atoms.

5. Heat-sensitive recording material according to claim 1, wherein said organic reducing agent is a polyhydroxy-benzene reducing agent containing at least one benzene nucleus with two hydroxy groups in ortho-position.

6. Heat-sensitive recording material according to claim 1, wherein said acid-sensitive leuco dye and said acid-reacting dye developer therefor are separated by a barrier layer that on heating is permeable for at least one of said dye forming reagents.

7. A recording process wherein a heat-sensitive recording material is exposed to a heat pattern in direct thermal imaging whereby during the application of said pattern a visible image is formed in said recording material without the aid of (a) substances(s) that from the exterior are thermally pattern-wise transferred thereon and/or therein, and said heat-sensitive recording material comprises on the same side of a support, called the heat-sensitive side, one or more binder layers containing a substantially light-insensitive metal salt in thermal working relationship with at least one organic reducing agent, characterized in that said recording material also comprises an acid-sensitive leuco dye transformable into dye by means of an acid-reacting compound serving as dye developer that is in thermal working relationship with said leuco dye, wherein said leuco dye corresponds to the following general formula (A):

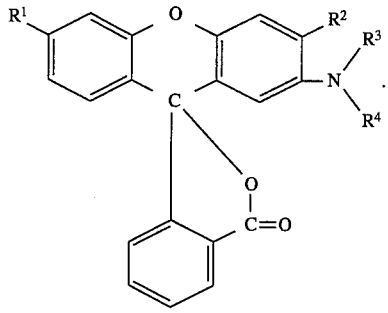

(A)

wherein:

$R^1$ represents a mono- or dialkylamino group in which said alkyl groups are substituted or unsubstituted, $R^2$ represents hydrogen, F, Cl, C1–C5 alkyl, C1–C5 alkoxy, phenyl or benzyl, $R^3$ represents hydrogen, a C1–C4 alkyl group, an alkaryl group, a cycloalkyl group or an aryl group, and $R^4$ represents a C1–C4 alkyl group, an alkaryl group, a cycloalkyl group or an aryl group.

8. Recording process according to claim 7, wherein said metal salt is a silver halide.

9. Heat-sensitive recording material according to claim 7, wherein said acid-reacting developer compound is a member selected from the group consisting of 1,3-bis-p-hydroxy-cumylbenzene, 1,4-bis-cymylbenzene, p-hydroxybenzoic acid butyl ester, bisphenols and mono-esters of aromatic ortho-carboxylic acids.

10. Heat-sensitive recording material according to claim 7, wherein said reducible metal salt is a substantially light-insensitive organic silver salt of aliphatic carboxylic acids, wherein the aliphatic carbon chain has at least 12 C-atoms.

11. Heat-sensitive recording material according to claim 7, wherein said organic reducing agent is a polyhydroxy-benzene reducing agent containing at least one benzene nucleus with two hydroxy groups in ortho-position.

12. Heat-sensitive recording material according to claim 7, wherein said acid-sensitive leuco dye and said acid-reacting dye developer therefor are separated by a barrier layer that on heating is permeable for at least one of said dye forming reagents.

13. Recording process according to claim 9, wherein said heat-sensitive recording material is image-wise heated by means of a thermal printhead containing a plurality of image-wise electrically energized heating elements.

* * * * *

UNITED STATES PATENT AND TRADEMARK OFFICE

CERTIFICATE OF CORRECTION

PATENT NO. : 5,559,075

DATED : September 24, 1996

INVENTOR(S) : Leenders et al.

It is certified that error appears in the above-identified patent and that said Letters Patent is hereby corrected as shown below:

Column 6, line 62, "palmirate" should read --palmitate--;

Column 7, line 51, "allyl" should read --alkyl--;

Column 10, line 51, "3,3,3′,3+" should read --3,3,3′,3′--;

Column 14, line 29, "silver halide" should read --silver salt--.

Signed and Sealed this

Twenty-fifth Day of March, 1997

*Attest:*

Bruce Lehman

BRUCE LEHMAN

*Attesting Officer*

*Commissioner of Patents and Trademarks*